US005623783A

United States Patent [19]

Kenkel

[11] Patent Number: 5,623,783

[45] Date of Patent: Apr. 29, 1997

[54] VENTED GLASS DOOR

[75] Inventor: Terry Kenkel, Des Moines, Iowa

[73] Assignee: Emco Enterprises, Inc., Des Moines, Iowa

[21] Appl. No.: 369,111

[22] Filed: Jan. 5, 1995

[51] Int. Cl.[6] ..... E05F 15/20

[52] U.S. Cl. ..... 49/21; 49/67; 49/501; 454/195

[58] Field of Search ..... 49/67, 61, 501, 49/21, 171; 454/195, 254

[56] References Cited

U.S. PATENT DOCUMENTS 2,871,523 2/1959 Negoro ..... 49/21

3,391,628 7/1968 Ziegenfelder ..... 454/195 X 4,048,756 9/1977 Lawrence ..... 454/195 X

*Primary Examiner*—Philip C. Kannan

*Attorney, Agent, or Firm*—Zarley, McKee, Thomte, Voorhees & Sease

[57] ABSTRACT

A vented glass door includes a rectangular frame having a glass window fitted in the center thereof. At least one air passageway is provided commencing at the rear surface of the frame members, and passing through the frame members themselves and outwardly through an outlet opening at the edges of the frame members.

10 Claims, 2 Drawing Sheets

VENTED GLASS DOOR

BACKGROUND OF THE INVENTION

This invention relates to a vented glass door.

Exterior doorways, particularly in northern climates, utilize two spaced apart doors in the door opening so as create a rapped air space there between. Usually the interior door is the heavier of the o and these doors are often made of wood which is finished with a natural finish or with paint. The other door is often a storm door made of aluminum, plastic, or wood. The storm door often includes a large window therein. When sunlight passes through the window it causes the air in the dead air space to be heated. This heated air can affect the paint surfaces on the interior door and can create discoloration and chipping of the pain or varnish.

Therefore a primary object of the present invention is the provision of an improved vented glass door.

A further object of the present invention is the provision of an improved vented glass door which permits the dead air in the space between two spaced apart doors to be vented to the atmosphere so as to minimize overheating of the air in the dead space.

A further object of the present invention is the provision of a vented glass door which is very simple in construction and yet which permits the air between the two spaced apart doors to be vented to the atmosphere.

A further object of the present invention is the provision of an improved vented glass door which facilitates the closing of the exterior door but permitting the venting of the pressurized air in the dead space between the two doors in the doorway.

A further object of the present invention is the provision of an improved vented glass door which is economical to manufacture, durable in use and efficient in operation.

SUMMARY OF THE INVENTION

The foregoing objects may be achieved by a vented glass door comprising a rectangular frame having a top frame member, a bottom frame member, and first and second side frame members. Each of the side frame members have an inner edge, an outer edge, a front face and a rear face. The inner edges of the top, bottom, first and second side frame members form a rectangular window opening, and a rectangular window is fitted within that opening and is operatively sealed therein. At least one vent passageway extends through at least one of the frame members. The vent passageway has a first opening in the rear face of the one frame member and a second opening in the outer edge of the one frame member. The passageway provides air communication between the first and second openings.

The door is adapted to be used in combination with another rectangular door which is mounted within a door opening in spaced relation to the vented glass door. The air passageway in the vented glass door permits the air in the dead space between the two doors to be vented to the atmosphere.

BRIEF DESCRIPTION OF THE DRAWINGS

FIG. 2 is a side sectional view of a door opening having the vented glass door of the present invention mounted therein in combination with another door to provide a dead space there between.

DETAILED DESCRIPTION OF THE PREFERRED EMBODIMENT

Figure 1:
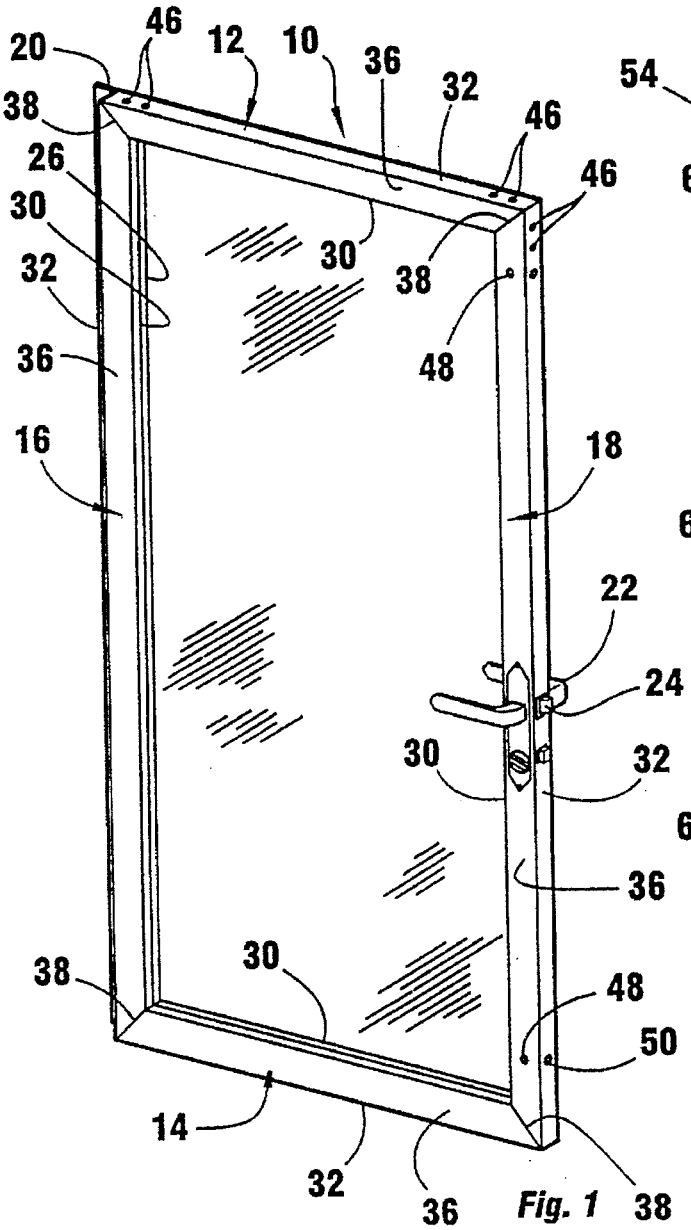
FIG. 1 is a perspective view of the vented glass door of the present invention.

Referring to the drawings the numeral 10 generally designates the storm door of the present invention. Door 10 includes a top frame member 12, a bottom frame member 14, and two opposite side frame members 16, 18. Extending along one side of the door is a hinge 20 and mounted on the other side of the door is a handle 22 which operates a latch 24. The top, bottom and side frame members are in a rectangular shape and form a rectangular window opening therein. A window 28 is mounted within the window opening 26 and is sealed therein.

Figure 4:
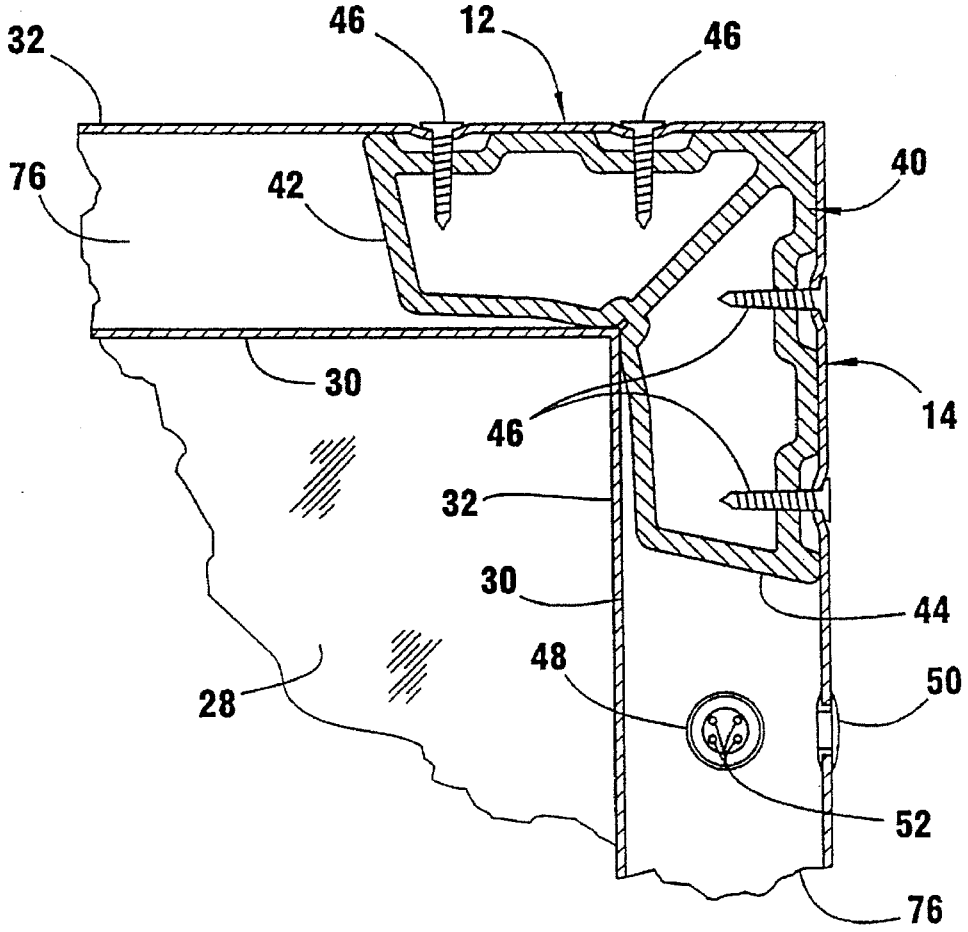
FIG. 4 is a sectional view taken along line 4—4 of FIG. 3.

Each of the top, bottom, and side frame members 12, 14, 16, 18 include an inner edge 30, and outer edge 32, a front face 34, and a rear face 36. The corners of the frames are formed by miter joints 38 between the frame members 12, 14, 16 and 18. Each of the miter joints 38 is held together by an L-shaped corner bracket 40 (FIG. 4) which is fitted within the hollow channels 76 which are within the four frame members 12, 14, 16, 18. Corner bracket 40 includes a first leg 42 and a second leg 44 and is secured to the various frame members by means of screws 46. A plurality of rear vent grommets 48 are fitted within openings in the rear faces 36 of the four frame members 12, 14, 16, 18, and provides air communication from the rear of the door 10 to the interior hollow channel 76 formed by the frame members 12, 14, 16, 18. A plurality of similar edge vent grommets 50 are provided in the outer edges of the frame members 12, 14, 16, 18. Each of the grommets 48, 50 is covered by a screen material 52 so as to prevent insects and dust from entering the interior space within the hollow channels 76.

Figure 2:
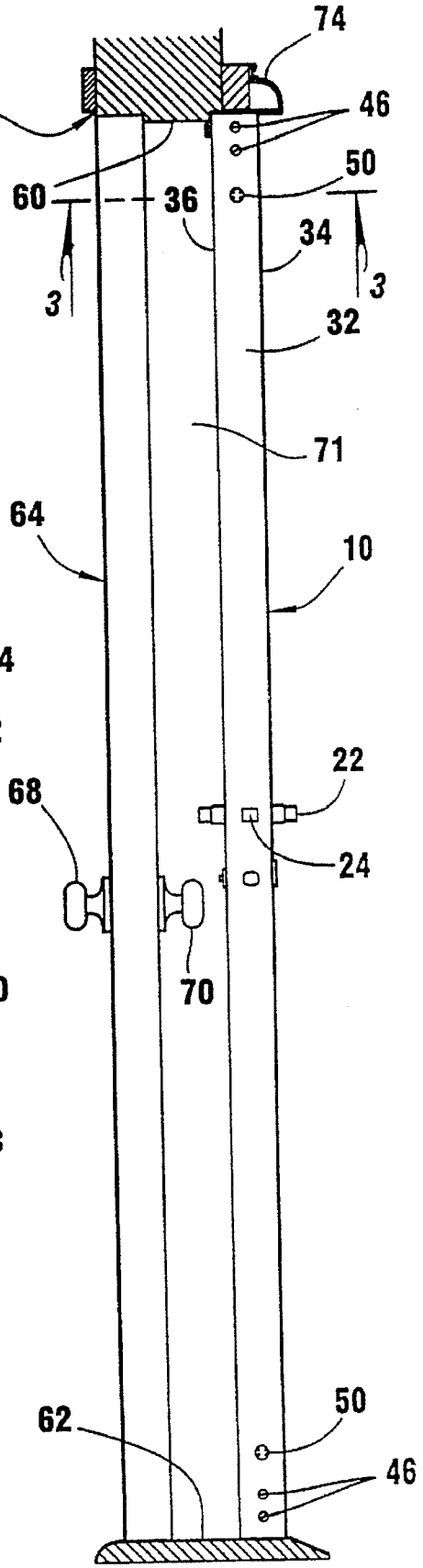
Figure 3:
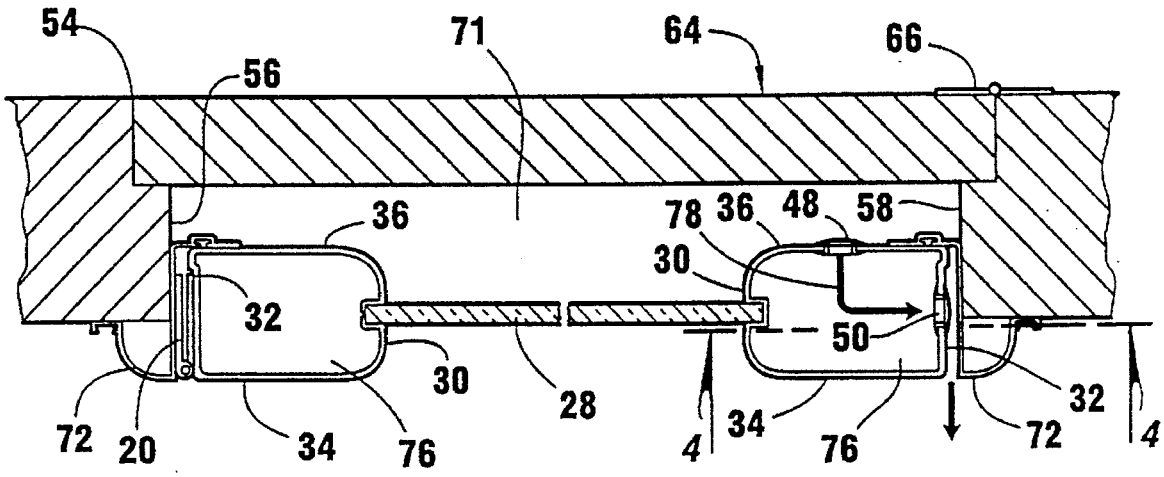
FIG. 3 is a sectional view taken along line 3—3 of FIG. 2.

Referring to FIGS. 2 and 3, the wanted glass door 10 is shown mounted within a rectangular door opening 54 formed by a pair of spaced apart side jambs 56, 58, a header 60, a threshold 62. Also mounted within door opening 54 is an inner door 64 having an inner door hinge 66, and a pair of door knobs 68, 70. As can be seen in FIG. 2, the two doors 10, 64 are spaced apart from one another and are sealed within the door opening 54 in such a manner as to create a trapped air space 71 there between.

The side jambs 56 are fitted with conventional Z-bars 72, and the header 60 is fitted with a Z-bar header 74 (FIG. 2).

When the doors 10, 64 are closed the trapped air space 71 is heated by virtue of the ultra-violet rays of the sun coming through the window 28. As this air is heated it is permitted to vent outwardly from the trapped air space 71 through the passageways provided by grommets 48, 50. The path of the air is shown by the arrows 78 as it passes through the grommets 48, the hollow channels 76 of the frame members, and the grommet 50.

Also, when door 64 is closed and door 10 is open, it is easier for the door 10 to close by virtue of the ability of the trapped air to escape through the passageways formed by grommets 48, 50 as the door is closing.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing form the spirit or scope of the invention as further defined in the following claims.

What is claimed is:

1. A vented glass door comprising:

A rectangular frame comprising a top frame member, a bottom frame member, and first and second side frame members, each of said frame members having an inner edge, an outer edge, a front face, and a rear face;

said inner edges of said top, bottom and first and second side frame members forming a rectangular window opening;

a rectangular window fitted within said window opening and being operatively sealed to said inner edges of said top, bottom, and first and second side frame members;

at least one vent passageway extending through at least one of said frame members, said vent passageway having a first opening in said rear face of said one frame member and a second opening in said outer edge of said one frame member and providing air flow along a path between said first and second openings;

said vent passageway being free from obstructions so as to always be open between the first and second openings.

2. A vented glass door according to claim 1 wherein said one frame member is elongated and includes an elongated hollow channel therein, said first and second openings providing air communication from outside said one frame member to inside said hollow channel.

3. The vented glass door of claim 1 wherein the vent passageway is located adjacent the top frame member.

4. The vented glass door of claim 1 wherein a second vent passageway extends through at least one of the frame members and is open at all times, the second vent passage being spaced apart from the one vent passageway, the second vent passageway having a first opening in said rear face of said one frame member and a second opening in said outer edge of said one frame member whereby air is free to flow along a second path between said first and second openings of the second vent passageway.

5. The vented glass of claim 4 wherein the second vent passageway is free from obstructions.

6. In combination:

a wall having a rectangular door opening therein;

a first rectangular door mounted within said door opening;

a rectangular second door mounted within said door opening in parallel spaced relation to said first door so as to create a trapped air space there between;

said second door comprising a rectangular door frame having a top frame member, a bottom frame member and first and second side frame members, forming a rectangular window opening, each of said frame members having an outer edge, an inner edge presented toward said window opening, a rear surface facing said first door, and a front surface;

A rectangular transparent sheet member fitted within said window opening and sealingly engaging said inner edges of said frame members;

at least one vent passageway extending through at least one of said frame members and being open at all times, and having a first opening in said rear face of said one frame member and a second opening in said outer edge of said one frame member whereby air is free to flow along a path from said trapped air space through said passageway and through said second opening of said passageway to said outer edge of said one frame member.

7. A combination according to claim 6 wherein said one frame member is elongated and includes an elongated hollow channel therein, said first and second openings providing air communication from outside said one frame member to inside said hollow channel.

8. The combination according to claim 6 wherein the vent passageway is free from obstructions.

9. The combination according to claim 6 wherein the vent passageway is located adjacent the top frame member.

10. The combination according to claim 6 wherein a second vent passageway extends through at least one of the frame members and is open at all times, the second vent passage being spaced apart from the one vent passageway, the second vent passageway having a first opening in said rear face of said one frame member and a second opening in said outer edge of said one frame member whereby air is free to flow along a second path from said trapped air space through said second vent passageway to said outer edge of said one frame member.

* * * * *